US008162707B2

(12) United States Patent
Levi et al.

(10) Patent No.: US 8,162,707 B2
(45) Date of Patent: Apr. 24, 2012

(54) SEMI-SUBMERGED PROPELLER PROPULSION SYSTEM OF DISPLACEMENT AND SEMI-DISPLACEMENT CRAFTS

(75) Inventors: Renato Levi, Isle of Wight (GB); Brunello Acampora, Naples (IT)

(73) Assignee: Flexitab S.r.l., Naples (IT)

( * ) Notice: Subject to any disclaimer, the term of this patent is extended or adjusted under 35 U.S.C. 154(b) by 364 days.

(21) Appl. No.: 12/159,638

(22) PCT Filed: Dec. 30, 2006

(86) PCT No.: PCT/EP2006/070286

§ 371 (c)(1), (2), (4) Date: Nov. 28, 2008

(87) PCT Pub. No.: WO2007/077205

PCT Pub. Date: Jul. 12, 2007

(65) Prior Publication Data

US 2009/0305584 A1 Dec. 10, 2009

(30) Foreign Application Priority Data

Dec. 30, 2005 (EP) ..... 05425948

(51) Int. Cl.
*B63H 5/15* (2006.01)

(52) U.S. Cl. ..... 440/67; 114/285; 440/79

(58) Field of Classification Search ..... 440/49, 440/50, 67, 79; 114/285, 271, 274, 284
See application file for complete search history.

(56) References Cited

U.S. PATENT DOCUMENTS

| | | | | |
|---|---|---|---|---|
| 1,044,176 | A * | 11/1912 | Hickman | 440/79 |
| 1,628,837 | A * | 5/1927 | Gebers | 440/79 |
| 2,031,436 | A * | 2/1936 | Thormeyer | 440/79 |
| 2,242,642 | A | 5/1941 | Bogert | |
| 3,938,463 | A * | 2/1976 | Hecker et al. | 440/79 |
| 5,803,776 | A | 9/1998 | Slynko et al. | |
| 6,116,004 | A * | 9/2000 | Penny et al. | 440/79 |
| 2005/0070180 | A1 | 3/2005 | Wolske | |

FOREIGN PATENT DOCUMENTS

| | | | |
|---|---|---|---|
| FR | 24094 | E | 2/1922 |
| GB | 203 169 | A | 9/1923 |
| GB | 233 191 | A | 5/1925 |
| GB | 2 248 433 | A | 4/1992 |

* cited by examiner

*Primary Examiner* — Lars A Olson
(74) *Attorney, Agent, or Firm* — Young & Thompson

(57) ABSTRACT

A propulsion system of displacement or semi-displacement ships, includes one or more propellers of semi-submerged type, arranged with a partial immersion of the sole bottom blades and with the top blades emerged, regardless of the state of motion and the trim of the craft. The propulsion system allows, employed power being equal, a higher propulsion efficiency and allows to keep the driveline of the propellers entirely above water level, wherein the semi-submerged propellers are arranged at the transom, the ratio of diameter (D) or sum of diameters (Np×D) of the semi-submerged propellers to craft width (L) at the water line (3) is greater than 0.50.

14 Claims, 3 Drawing Sheets

SEMI-SUBMERGED PROPELLER PROPULSION SYSTEM OF DISPLACEMENT AND SEMI-DISPLACEMENT CRAFTS

BACKGROUND OF THE INVENTION

1. Field of the Invention

The present invention relates to a propulsion system of displacement and semi-displacement crafts, where by displacement craft it is meant a craft that, along axes perpendicular to the water plane, is subjected only to buoyancy and not to the lift generated by the in-water motion of the craft. By semi-displacement crafts it is meant crafts in which said lift has an effect lower than said buoyancy and in which the bottom, at the speeds of design, is intended to remain immersed. Such crafts, utilized for shipping cargoes of considerable or anyhow high tonnage, are characterised by medium-low or low navigation speeds.

Such crafts differ from those whose trim is variable, i.e., markedly influenced by the lift generated by in-water motion, and in particular from water-planing ones, with the bottom completely emerged or only partially submerged. These crafts generally display at least medium-high navigation speeds.

2. Description of the Prior Art

Modern naval propulsion envisages the use of propellers, paddle wheels or jet systems.

For crafts having, in navigation, a water-immersed hull, the most widespread system utilizes fully immersed propellers, usually arranged at the craft stern. They envisage an at least partially immersed shaft line, coming out of the hull, entailing a series of complications of constructive and fluid-dynamics nature to support the driving gears, i.e., hull appendages such as shafts and shaft supports. This propulsion has become established in decades of naval technology with propulsion efficiencies generally deemed acceptable, in particular for low-speed crafts.

However, said efficiency does not appear to be substantially improvable anymore, save with the adoption of different propulsion systems.

PCT Appln. Pub. No. WO-01/47770 (Fleš) describes the use of paddle wheels for naval propulsion, with axis of rotation parallel to the longitudinal direction of the craft, i.e. the direction of motion.

Incidentally, by paddle wheel it is meant a rotary device in which the overall diameter is covered more by the diameter of the hub and of the blade support disk, with respect to the extension of the blades themselves. On the contrary, by propeller it is meant a rotary device in which the overall diameter is basically covered by the extension of the blades, rather than by the hub diameter. The devices of said PCT applications are intended for the propulsion of medium-speed (40÷60 knots) crafts and have an immersed blade crown sector of limited extension, so that the support disk is basically emerged.

This propulsion, in addition to suffering from intrinsic vibration problems and requiring complex adjustment mechanisms, is not suitable for speeds lower than 40 knots, in particular at cruising speeds deemed low (10÷30 knots). Another example, similar to the above one, is described in U.S. Pat. No. 6,851,991 (Eriksson), related to the use of paddle wheels running semi-submerged, built in the bottom and suitable for competition crafts.

The art is also aware of the use of the so-called semi-submerged propellers, also called surface-piercing. Such propellers run with the bottom half approximately immersed and the top half basically emerged. Thus, the side of the blades under negative pressure lies at a basically atmospheric pressure that prevents cavitation problems, making these propellers particularly suitable for very high rotation speeds, typical of variable-trim crafts, usually planing and characterised by high or very high speeds. Moreover, such an operation mode allows to keep emerged, i.e. "shaded" by the transom, the propulsion appendages (shafts and supports) at planing speeds.

This type of propellers have always been deemed unavoidably characterised by low propulsion efficiency, therefore totally unsuitable for crafts navigating at medium-low speeds. In particular, it is commonplace that such low propulsion efficiency could be favourably compensated for merely by the absence of immersed appendages at driving speeds. Therefore, the application range of these propellers has always been restricted to yachting and competition crafts or, in some sporadic instances, to cargo or military crafts, always characterised by high or very high operative speeds, usually in planing regimen. In their typical application, the semi-submerged propeller comes partially out of water only when the craft is in motion, whereas it remains completely immersed when the craft is not in motion.

Examples of this kind of application can be found in Italian Pat. No. 1,184,406 (Levi), in PCT Publ. No. WO-96/40550 (Arneson) and in U.S. Pat. No. 6,332,818 (Duncan et al.) describing a sort of hybrid between paddle wheel and surface-piercing propeller, fitted with a wide-diameter hub and short blades, spaced thereamong.

SUMMARY OF THE INVENTION

The technical problem underlying the present invention is to provide a propulsion system overcoming the drawbacks mentioned with reference to the known art, concomitantly surmounting the prejudices established in the evolution of the art.

Such a problem is solved by a propulsion system of displacement or semi-displacement crafts, comprising one or more semi-submerged propellers, arranged with a partial immersion of the sole bottom blades and with the top blades emerged, regardless of the state of motion and the trim of the craft, wherein said semi-submerged propellers are arranged at the transom, the ratio of diameter or sum of diameters of the semi-submerged propellers to craft width at the water line is greater than 0.50.

The main advantage of the propulsion system according to the present invention lies in allowing a higher overall propulsion efficiency. Moreover, the driving line (driveline) of the semi-submerged propellers lies entirely above water level, with evident constructive simplifications and fluid-dynamics advantages due to the absence of immersed appendages.

The present invention will hereinafter be described according to a preferred embodiment thereof, along with some preferred applications thereof, given by way of example and not for limitative purposes with reference to the following examples and to the annexed drawings

DESCRIPTION OF THE PREFERRED EMBODIMENT

Referring to the figures, a displacement or partial displacement craft is partially and schematically depicted, and denoted by 1. It incorporates a propulsion system arranged at the transom 2 of the craft 1, at which it is highlighted a water line 3 whose position is not subject to significant variations at the changing of the state of motion or the speed of the craft.

It is important to point out that the variation in the immersion of the craft, and therefore of the propellers, due to different cargo-loading conditions, does not prejudice the operation of the propulsion system. In fact, in order to correctly position the propellers, not only the immersion will be taken into account under the most significant loading condition; even flow control systems may be resorted to.

Onto the transom 2, the propulsion system comprises, in this embodiment, a pair of propellers 4 of semi-submerged type, in short semi-submerged propellers.

Figure 1:
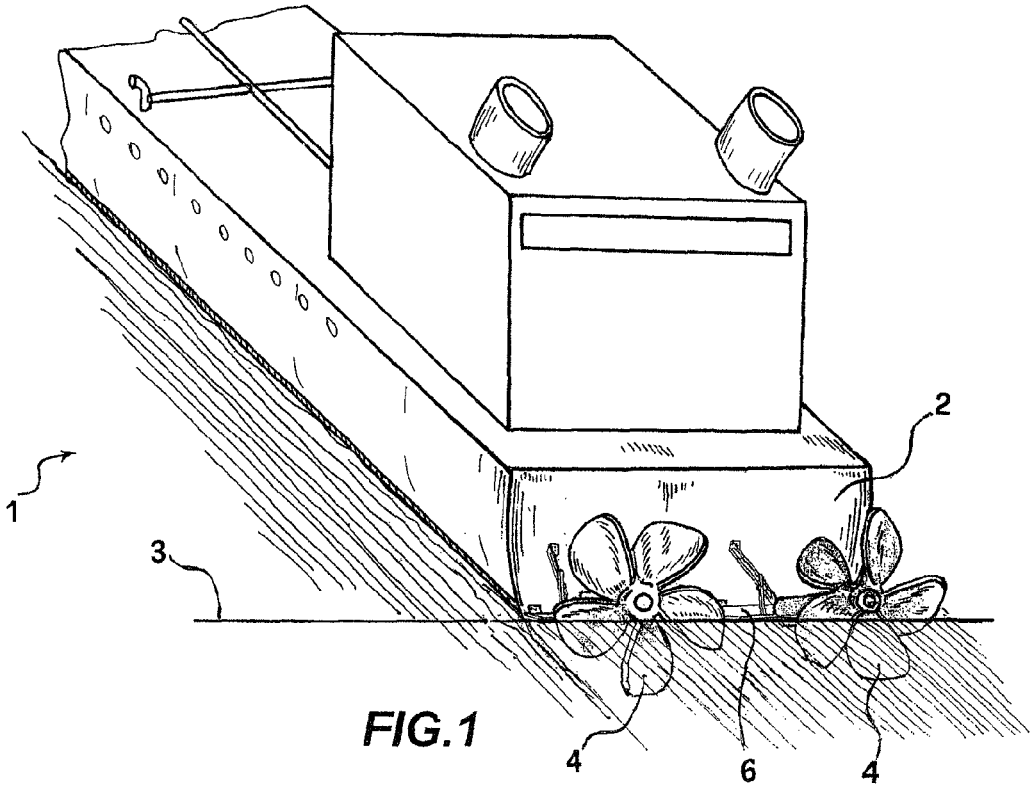
FIG. 1 shows a schematic perspective view of a craft incorporating a first embodiment of the propulsion system according to the invention.
Figure 2:
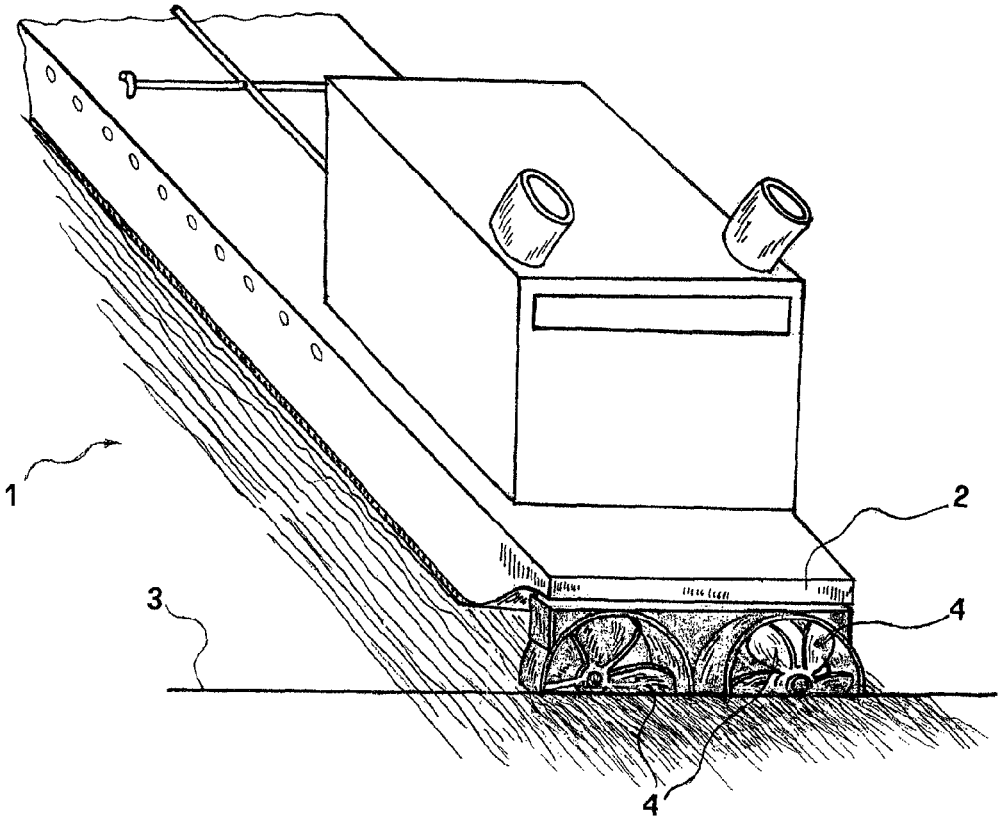
FIG. 2 shows a schematic perspective view of a craft incorporating a second embodiment of the propulsion system according to the invention.

In FIGS. 1 and 2, the propellers 4 are contra-rotating. The driving line (driveline) of the propellers 4, contained inside the hull at the transom 2, lies entirely above the water plane of the craft. Therefore, there is no necessity for the holes through the propeller shafts to be provided with depth seals; usual tight seals will suffice.

Referring to FIG. 1, the propellers 4 are mounted directly on the transom 2 and have each a hub 5 that is arranged basically just above the water line 3. Between the transom 2 and the propellers 4 there may be provided control means for controlling the stern wave, i.e. the wave forming by effect of the wake just downstream of the stern of the craft in motion.

Such a wave could submerge the propellers 4. For this purpose, said control means have a balancing flap 6, optionally adjustable in height, squashing the wave in the water immediately at the propellers, so as to keep the water line 3 in a basically constant position.

However, it is understood that the need or the lack thereof, to mount this flap depends on how the propellers 4 are fixed to the transom 2. Should the propellers be nearly into contact of the aft wall, such means might be not needed.

Figure 3:
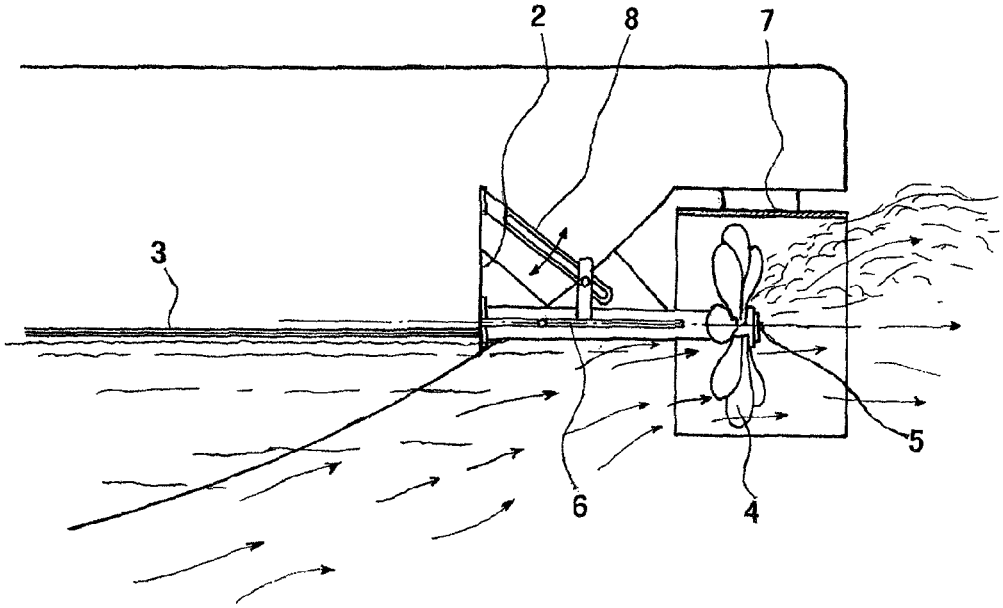
FIG. 3 shows an elevational side view of the stern of the craft of FIG. 2.

Referring to FIGS. 2 and 3, a second embodiment provides the presence of a shroud 7 arranged above each propeller 4, in order to guide the wake formed. Moreover, it is highlighted the control means for controlling the height of the stern wave, with an arm 8 for adjusting the flap 6.

In both of the embodiments described above, it is possible that the propellers be revolving along a vertical axis, e.g. to compensate for the transversal component of the thrust vector, possibly generated even by an elastic deformation of the propeller blades at high speed.

Moreover, the propellers could further be revolving along a horizontal axis perpendicular to the axis of motion, e.g. to vary the plunge angle of the blades in the water. Lastly, the pitch of the propellers could be variable, to adapt them to different running conditions.

Figure 4:
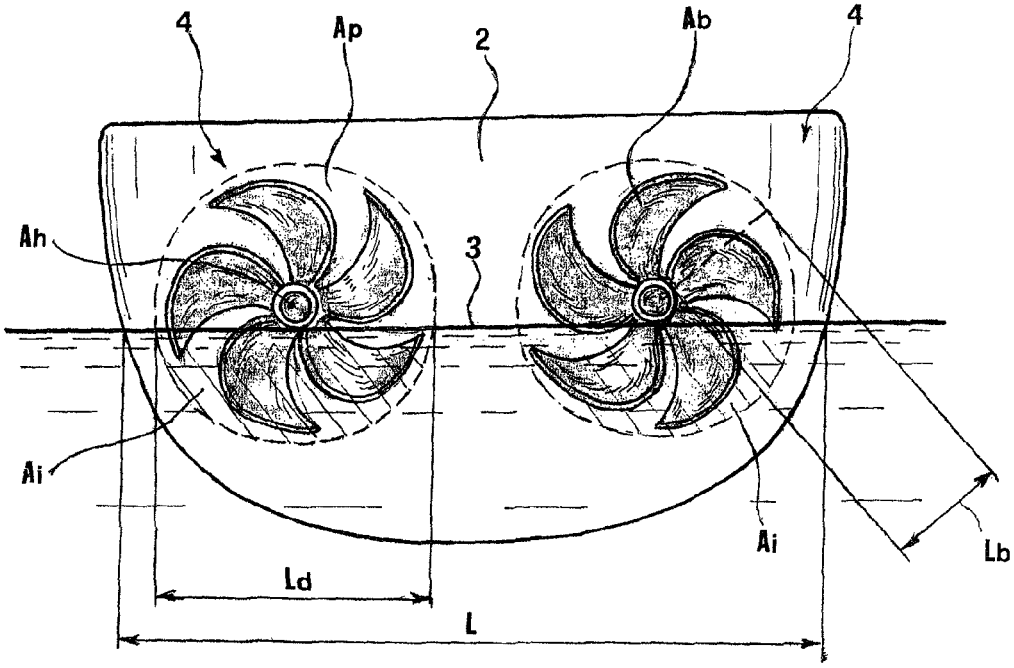
FIG. 4 shows a schematic elevational view of the transom of the craft of FIG. 1, to illustrate some relevant quantities thereof.

Referring to each propeller 4 and to FIG. 4 there may be highlighted the following parameters:

Np=Number of semi-submerged propellers

D=diameter of propeller 4

P=propeller pitch, i.e., the advance caused by a single revolution of the propeller Nb=number of blades Lb=height of each blade calculated from the connection onto the hub Ap=propeller area Ab=overall blade area Ah=area of the hub 5

Ai=area of the propeller immersed, below the water line 3

L=craft width at the water line

It is understood that the number of propellers Np may range from 1 to n, as long as compatible with the constructive requirements the craft has to be subject to. The number chosen in this example allows the adoption of contra-rotating propellers 4 in which the transversal component of the thrust vectors produced by each propeller 4 is compensated for.

However, it is understood that the number could vary. In particular, the propellers could be four, in order to reduce the diameters of the individual propellers concomitantly keeping immersed an adequate surface of the blades, with advantages in terms of cost of the individual propellers and with the option of shipping cargo astern with a stern ramp. In this case, the four propellers would be arranged below the ramp.

According to another variant, there could be mounted, on a single shaft, a pair of contra-rotating propellers.

In the present example 5-blade propellers are depicted, yet the number of blades Nb could be freely selected in the light of construction needs. However, a number of blades Nb greater than or equal to four allows to more easily attain a greater covering of the propeller area Ap by the blade area Ab.

The shape of the individual blades is not an object of the present invention, and it could be selected according to designing needs.

The ratio of Ai to Ap will range from 0.30 to 0.55, to assure correct operation of the semi-submerged propeller 4. In fact, the emerged portion of the propeller drags below the free surface of the water a quantity of air allowing to the side under negative pressure of the immersed blades to run at atmospheric pressure, preventing cavitation problems.

Ideally, the hub 5 of each propeller 4 will be arranged just above the water line 3. Preferably, the ratio of Ai to Ap will range from 0.35 to 0.45.

The ratio of Ah to Ap is lower than 0.30, to have a blade length of sufficient extension with respect to the overall dimension of the propeller 4. Preferably, said ratio could range from 0.10 to 0.20.

The ratio of Ab to Ap is greater than 0.60, to have a blade surface sufficing to displace a water quantity suitable for the needs of the propulsion. Preferably, said ratio could range from 0.60 to 0.80.

The ratio of diameter D or sum of diameters Np×D of the semi-submerged propellers to craft width L at the water line is greater than 0.50, so that the propellers, overall, may displace a flow of width adequate with respect to the craft width. Advantageously, said ratio could range from 0.70 to 0.95.

The ratio of quantity 2×Np×Lb to L is preferably greater than or equal to 0.50, always to ensure a thrust flow of adequate width. Preferably, said ratio could range from 0.70 to 0.85.

The ratio of D to P ranges from 0.80 to 1.20, to attain the best operative conditions at the speeds provided for the propulsion system at issue. Preferably, said ratio will range from 0.9 to 1.1.

EXAMPLE

A scale model of displacement craft was tested in towing tank, fitted with a pair of contra-rotating and semi-submerged propellers, with the water line basically tangential to the bottom edge of the hub.

The operative conditions are as follows:

Np=2

Nb=5

Ai/Ap=0.40

Ah/Ap=0.1786—with a 280 mm propeller diameter and a 50 mm hub diameter

Ab/Ap=0.70

2×Np×Lb/L=0.75

Np×D/L=0.913

Figure 5:
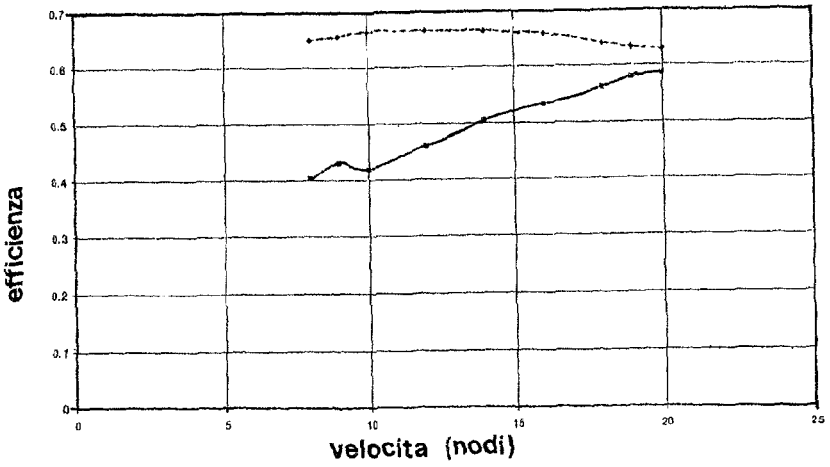
FIGS. 5, 6 and 7 show graphs illustrating the performances of an exemplary propulsion system.
Figure 7:
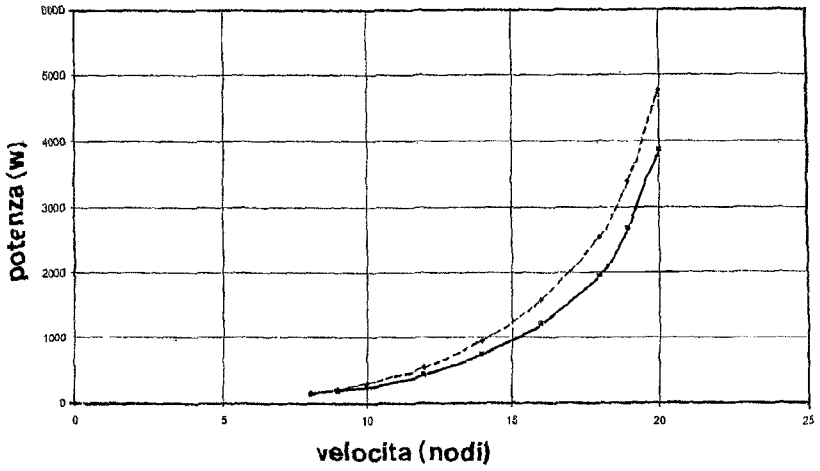
Figure 6:
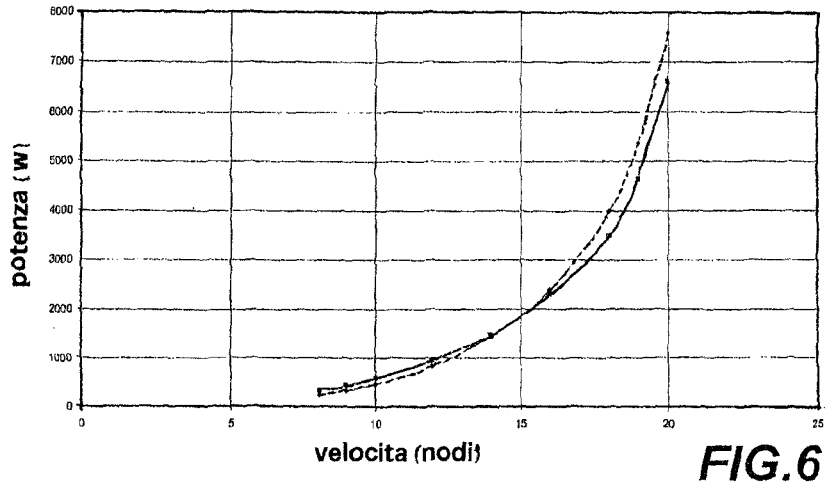

With this model, tests were carried out whose results are depicted in the graphs of FIGS. 5 to 7.

In the graph of FIG. 5, the net efficiency of a traditional propeller (dashed line), intended to operate in full immersion, is compared to the propeller used in the tests (solid line) according to operative speeds, expressed in knots (1 knot=0.514 m/s). As it is apparent, the performances of a traditional propeller are, in principle, superior to those attainable with a semi-submerged propeller. In this case the traditional propeller has been selected on the basis of the propeller that would have been adequate for the same model.

Using as reference the same traditional propeller used to plot the graph of FIG. 5, a simulation was carried out to obtain which powers would have been required to drive the craft model at a given speed.

As it is apparent from the graph of FIG. 6, the semi-submerged propeller offers more advantageous performances for speeds higher than 15 knot (lower power required to obtain a certain speed) but this plotting takes into account the raw values of the power, influenced by the complex supports that are for supporting the pair of semi-submerged propellers.

A more realistic simulation is attained when plotting anew the preceding graph eliminating the contribution of said supports, as the use of this propulsion system would imply a novel stern design without them.

Such a simulation yielded the graph of FIG. 7, in which evidently the thrust efficiency of the semi-submerged propellers is improved with respect to those of the traditional propellers for speeds even lower than 10 knots.

Such a result confirms the advantageousness of the use of the above-described propulsion system. On the basis of said simulations, it is possible to calculate fuel saving, e.g. on medium- or high-tonnage container ships: such a saving is in the neighbourhood of 10%.

To the above described propulsion system a person skilled in the art, in order to satisfy further and contingent needs, may effect several further modifications and variants, all however comprised in the protective scope of the present invention, as defined by the appended claims.

The invention claimed is:

1. A propulsion system of displacement or semi-displacement ships, comprising one or more propellers of semi-submerged type, arranged with a partial immersion of bottom blades and with top blades emerged, regardless of craft state of motion and trim, wherein:

a) said semi-submerged propellers are arranged at a ship's transom;

b) a ratio of diameter (D) or a sum of diameters (Np×D) of the semi-submerged propellers to craft width (L) at a water line is greater than 0.50;

c) a ratio of overall blade area (Ab) to propeller area (Ap) is greater than 0.60;

d) a ratio of area (Ai) of the propeller immersed, below the water line, to propeller area (Ap) ranges from 0.30 to 0.50; and e) further comprising control means for controlling a height of a stern wave, wherein said means for controlling the height of the stern wave comprises a balancing flap arranged between the semi-submerged propellers and the ship's aft wall.

2. The propulsion system according to claim 1, wherein the ratio between overall blade area (Ab) and propeller area (Ap) ranges from 0.60 to 0.80.

3. The propulsion system according to claim 1, wherein said one or more propellers of semi-submerged type includes a pair of contra-rotating semi-submerged propellers.

4. The propulsion system according to claim 1, wherein the semi-submerged propellers have a number of blades (Nb) greater than or equal to four.

5. The propulsion system according to claim 1, wherein a hub of each propeller is arranged just above the water line.

6. The propulsion system according to claim 1, wherein the ratio of area (Ai) of the propeller immersed, below the water line, and propeller area (Ap) ranges from 0.35 to 0.45.

7. The propulsion system according to claim 1, wherein a ratio of hub area (Ah) to propeller area (Ap) is lower than 0.30.

8. The propulsion system according to claim 7, wherein said ratio of hub area (Ah) to propeller area (Ap) ranges from 0.10 to 0.20.

9. The propulsion system according to claim 1, wherein a ratio of quantity 2×Np×Lb, where Np is a number of the semi-submerged propellers, Lb is a height of each blade calculated from the connection onto the hub, and L is the craft width at the water line, is greater than or equal to 0.50.

10. The propulsion system according to claim 9, wherein said ratio of quantity 2×Np×Lb ranges from 0.70 to 0.85.

11. The propulsion system according to claim 1, wherein the ratio of propeller diameter (D) to a propeller pitch (P) ranges from 0.80 to 1.20.

12. The propulsion system according to claim 11, wherein said ratio of propeller diameter (D) to propeller pitch (P) ranges from 1.00 to 1.10.

13. The propulsion system according to claim 1, wherein the ratio of diameter (D) or the sum of diameters (Np×D) of the semi-submerged propellers to the craft width (L) at the water line (3) ranges from 0.70 to 0.95.

14. The propulsion system according to claim 1, wherein each semi-submerged propeller is encased topwise by a shroud.

* * * * *